US005186564A

United States Patent [19]

Fuhrmann, III et al.

[11] Patent Number: 5,186,564

[45] Date of Patent: Feb. 16, 1993

[54] VENTED REMOVABLE CAP

[75] Inventors: Arthur D. Fuhrmann, III, Northford; Craig Stevens, Bethany; Glenn Gramolini, Ansonia, all of Conn.

[73] Assignee: BIC Corporation, Milford, Conn.

[21] Appl. No.: 791,897

[22] Filed: Nov. 13, 1991

[51] Int. Cl.[5] ..... B43K 9/00

[52] U.S. Cl. ..... 401/202; 401/213; 401/243; 401/247

[58] Field of Search ..... 401/202, 213, 243, 247

[56] References Cited

U.S. PATENT DOCUMENTS

| | | |
|---|---|---|
| 4,459,059 | 7/1984 | Greenspan . |
| 4,500,220 | 2/1985 | Hashimoto . |
| 4,844,642 | 7/1989 | Inaba et al. . |
| 4,915,529 | 4/1990 | List . |
| 4,929,109 | 5/1990 | Ikenaga . |
| 4,969,766 | 11/1990 | Nagle et al. . |
| 5,000,603 | 3/1991 | Isoda . |
| 5,000,604 | 3/1991 | Isoda . |
| 5,054,949 | 10/1991 | Heger . |
| 5,061,105 | 10/1991 | Isoda . |
| 5,066,156 | 11/1991 | Petrillo et al. . |
| 5,073,056 | 12/1991 | Belmondo . |
| 5,076,721 | 12/1991 | Belmondo . |

FOREIGN PATENT DOCUMENTS

| | | | |
|---|---|---|---|
| 0204252 | 12/1986 | European Pat. Off. . | |
| 0330877A2 | 9/1989 | European Pat. Off. . | |
| 668620 | 12/1938 | Fed. Rep. of Germany | 401/247 |
| 3526759A1 | 1/1987 | Fed. Rep. of Germany . | |
| 3728896C1 | 6/1988 | Fed. Rep. of Germany . | |
| 3817248 | 10/1989 | Fed. Rep. of Germany | 401/243 |
| 1419530 | 10/1965 | France | 401/247 |
| 8911978 | 12/1989 | PCT Int'l Appl. . | |
| 2215279A | 9/1989 | United Kingdom . | |
| 2220199 | 1/1990 | United Kingdom . | |
| 2224244 | 5/1990 | United Kingdom | 401/243 |
| 2229967A | 10/1990 | United Kingdom . | |

*Primary Examiner*—Steven A. Bratlie

*Attorney, Agent, or Firm*—Dilworth & Barrese

[57] ABSTRACT

A vented removable cap includes an outer cylindrical member and an inner cap member suspendedly mounted in the cylindrical member. A partial enclosure wall is integrally formed with the cylindrical member at an end thereof. The partial enclosure wall includes a circumferential hub having at least one radially extending rib and at least one arcuately-shaped aperture. The inner cap member is mounted within the circumferential hub by the engagement of a head portion of the inner cap member with a circumferential ledge disposed in the hub.

27 Claims, 10 Drawing Sheets

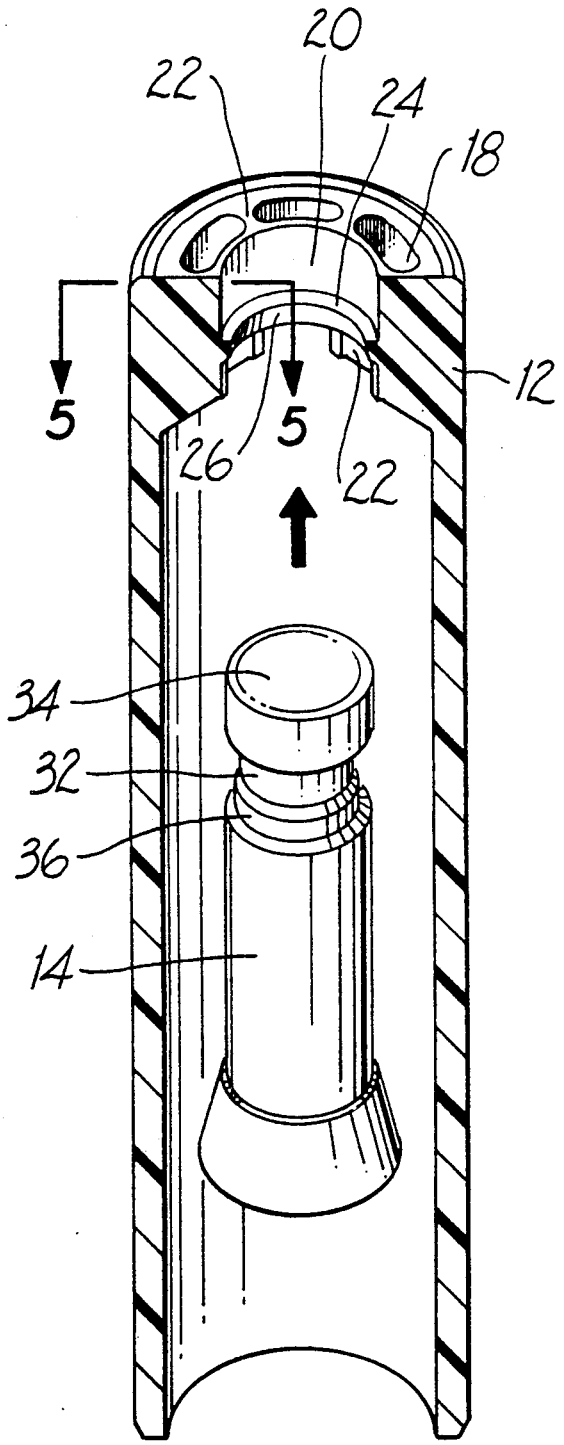
FIG. 4
FIG. 5
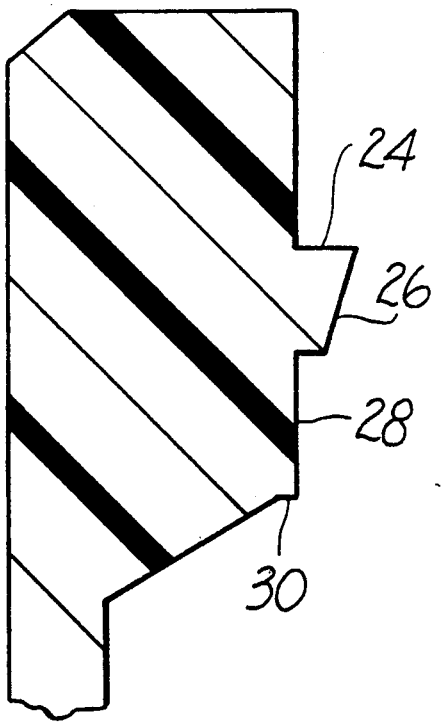

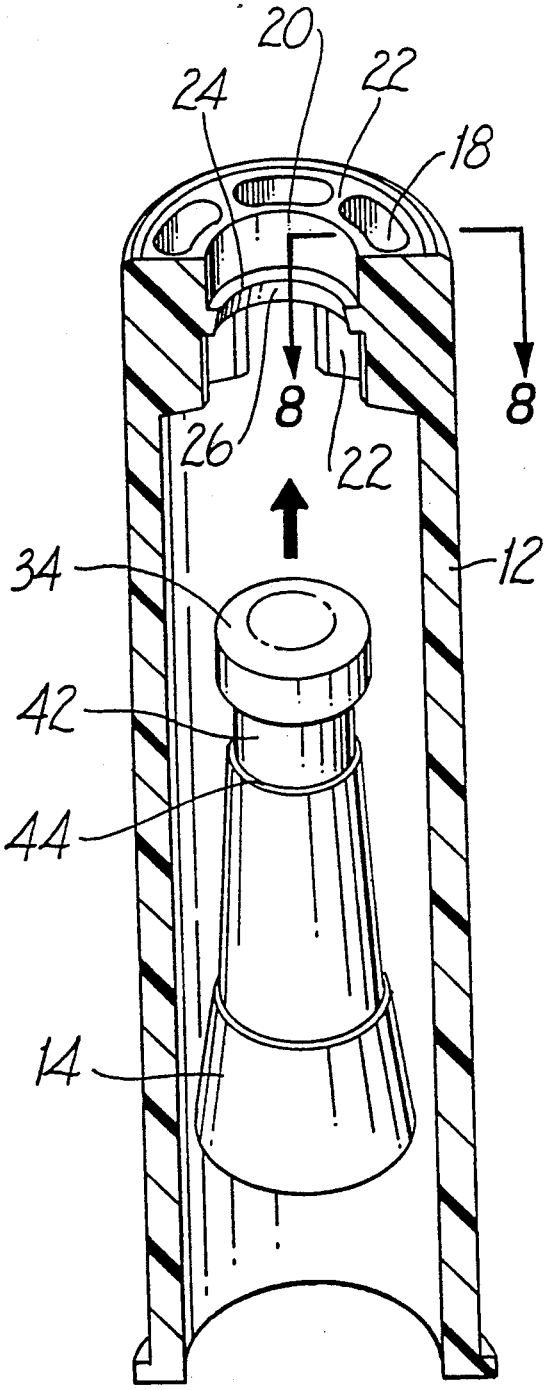
FIG. 7
FIG. 8
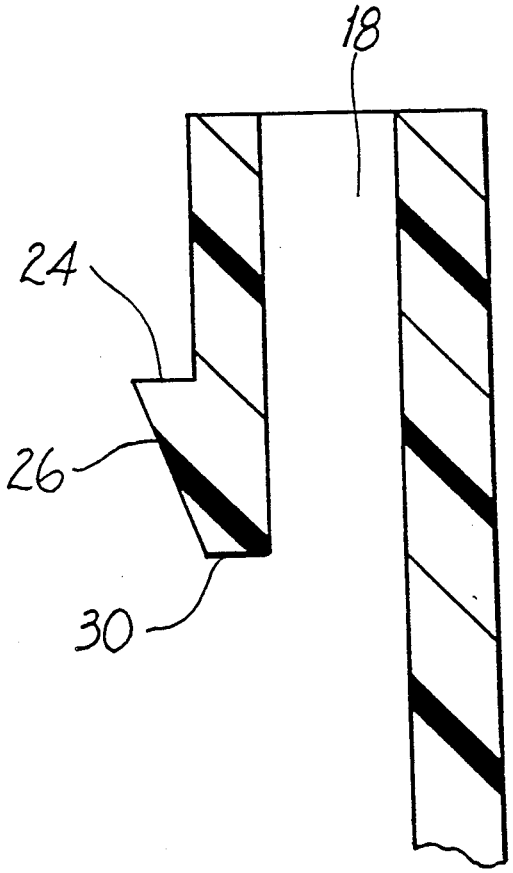

VENTED REMOVABLE CAP

BACKGROUND OF THE INVENTION

1. Field of the Invention

The present invention relates to removable caps for writing implements, and relates in particular, to a vented removable cap adapted to allow for the flow of air therethrough while engaging the nib or writing portion of the implement to prevent the evaporation of ink therefrom.

2. Discussion of the Prior Art

Removable caps for writing implements which use ink are configured to enclose the writing or nib portion of the implement to prevent the evaporation of the ink therein as well as to protect the functional components. A conventional removable cap typically includes an outer cylindrical member having an inner cap disposed in the interior of the cylindrical member for receiving and forming an air tight seal around the writing portion of the implement. In one known type, the removable cap has a double walled construction closed at a first end and open at a second end, where the inner cap and the outer cylindrical member are integrally formed as a single unit.

Recently, it has become desirable to construct a removable cap which not only provides an adequate seal around the writing portion of an implement, but also permits air to flow axially through the interior of the cap when the cap is detached from the implement. Such removable caps typically include an outer hollow main body, an inner cap disposed within and secured to the main body, and interconnected apertures and/or spaces to establish the air passage. Examples of such configurations are described in U.S. Pat. Nos. 5,000,603 to Isoda, 5,000,604 to Isoda, GB 2220199, and PCT Application WO 89/11978.

In U.S. Pat. No. 5,000,603 to Isoda, a removable cap includes an inner cylinder positioned within an outer cylindrical body. A plurality of ribs are provided on the outer peripheral surface of the inner cylinder to secure the inner cylinder to the outer body along its mid-length, and an outer flange is provided at the open end of the inner cylinder to secure the inner cylinder to the outer cylindrical body at its bottom portion also. A complex air passageway arrangement provides communication between the inner cavity and the external atmosphere.

U.S. Pat. No. 5,000,604 to Isoda discloses an inner cylinder for covering the tip of the writing instrument secured to a double-walled outer cylinder. The inner wall of the double-walled outer cylinder is provided with a plurality of axially directed slits, and the axially directed land portions between the slits are secured to the inner cylinder. Communication between the inner cavity and the external atmosphere is provided by the axially directed slits of the inner wall of the double-walled cylindrical outer body.

British Patent Application GB 2220199 describes an outer cylindrical cap body having an inner cylinder positioned therein where the inner cylinder is secured to the outer cylinder at its open end. Air passage slots are provided adjacent the open end of the inner cylinder, and the slots are sealed by the body of the writing instrument when it is inserted into the cap. Upon removal of the body of the writing instrument, the air passage slots provide communication between the interior cavity of the cap and the outer atmosphere.

PCT Application WO 89/11978 describes a pen cap having an outer cylindrical body with an inner cylinder mounted by axially directed land portions adjacent a bore hole at the closed end of the outer cylinder.

Another known type of vented removable cap is illustrated in FIGS. 20 and 21 of the drawings. In accordance with this device, a conically shaped inner cap 100 having a plurality of axially extending ribs 102 integrally molded with the inner cap is mounted within an outer tubular member 104. Each rib 102 possesses a groove 106 which locks with an annular rib 108 formed on the inner surface of the outer tubular member to effect the mounting. The axial extending ribs 102 directly abut the inner peripheral surface of the outer tubular member, and outer tubular member 104 also possesses raised portions 110 which are in contact with the peripheral surface of the inner cap. Air passage slots are provided between the axial ribs of the inner cap.

Although these caps are effective in sealing the writing portion of the implement and also incorporate provisions to enable external air to flow through the interior of the cap when the cap is detached from the implement, these devices present a number of disadvantages. For example, each cap includes an inherently complex design, specifically with regard to the mounting of the inner cap to the main cap body which requires close tolerances during construction to prevent obstruction of the vent openings. Furthermore, the inner caps of these devices are supported by the main cap bodies along a substantial portion of the peripheral surfaces of the inner caps, such that any pivotal movement of the inner cap relative to the main cap body is minimized or eliminated, requiring precise molding and constructional tolerances. Consequently, if the inner cap is assembled in non-axial alignment relative to the main cap body, which may occur due to the precision in which the component parts are manufactured, the inner cap is not capable of adjusting its position relative to the main cap body to receive the writing portion of the implement.

SUMMARY OF THE INVENTION

A removable cap for receiving a writing implement is provided, comprising a generally cylindrical member having an opening at one end for receiving the implement and a partial enclosure wall integrally formed with the cylindrical member at a second end. The partial enclosure wall comprises a closed circumferential hub having a central opening, the hub being concentric with the cylindrical member and including at least one radially extending rib projecting therefrom to secure the hub to the cylindrical member. The partial enclosure wall also includes at least one generally arcuately shaped opening surrounding the circumferential hub through which the interior of the cylindrical member communicates with external air. An inner cap member is mounted within the cylindrical member in general axial alignment therewith and includes an opening at one end and a closing wall at a second end for receiving and sealing a writing point of the implement. Mounting means are provided for suspendedly mounting the inner cap member adjacent its closed end within the central opening of the circumferential hub.

In one preferred embodiment, the inner cap member includes a circumferential groove disposed adjacent the closed end of the inner cap member. The circumferential groove defines a head portion at the closed end of the inner cap member and terminates in a raised edge at a position adjacent a body portion of the inner cap member intermediate the open end of the inner cap member and the circumferential groove. The circumferential hub includes a ledge member disposed on an inner surface thereof, where the ledge member has an inner diameter that is less than the diameter of the head portion of the inner cap member. The ledge member may also include a beveled or tapered surface to facilitate insertion of the inner cap into the hub.

In assembly, the head portion of the inner cap is received within the central opening of the circumferential hub and engages with the ledge member of the hub to suspendedly mount the inner cap member. Furthermore, the inner diameter of the circumferential hub is less than the diameter of the raised edge of the inner cap member, so that once the inner cap member is mounted, the raised edge engages the end of the hub within the interior of the cylindrical member to retain the head portion within the circumferential hub. The beveled surface provided on the circumferential hub facilitates the insertion of the inner cap member within the hub during assembly.

In an alternative embodiment, the inner cap member includes a circumferential groove with the raised edge eliminated and the circumferential hub includes a circumferential rib having a hemispherical cross-section. The groove and the rib interlock to suspendedly mount the inner cap member to the partial enclosure wall. In another embodiment, the circumferential hub is provided with at least one outwardly projecting tab, while the inner cap member includes at least one corresponding recess which interlocks with the tab to mount the inner cap member to the hub.

In accordance with another embodiment of the present invention, the circumferential hub is eliminated, and the partial enclosure wall comprises at least one radially projecting land portion which secures the inner cap directly to the land portion. The land portion defines at least one aperture through which the interior of the cylindrical member communicates with air external to the cap. Preferably, the partial enclosure wall includes two land portions. The inner cap member may be suspendedly mounted to the land portions by any of the aforementioned means.

The present invention is directed to a removable cap for a writing implement which effectively seals the writing portion of the implement to prevent the evaporation of ink therein while permitting air to axially flow through the interior of the cap when the cap is detached from the implement. The present invention is relatively simple to manufacture and assemble and facilitates adjustment of its axial alignment relative to the main cap body.

BRIEF DESCRIPTION OF THE DRAWINGS

Preferred embodiments of the invention are described hereinbelow wherein:

FIG. 4 is a perspective cross-sectional view of a longitudinal section of the removable cap of FIG. 2 prior to assembly;

FIG. 5 is an enlarged cross-sectional view of th mounting surface of a circumferential hub of the removable cap of FIG. 1;

FIG. 7 is a perspective cross-sectional view of a longitudinal section of the embodiment of FIG. 6 prior to assembly;

FIG. 8 is an enlarged cross-sectional view of the mounting surface of the circumferential hub of the embodiment of FIG. 6;

DETAILED DESCRIPTION OF THE DRAWINGS

Figure 1:
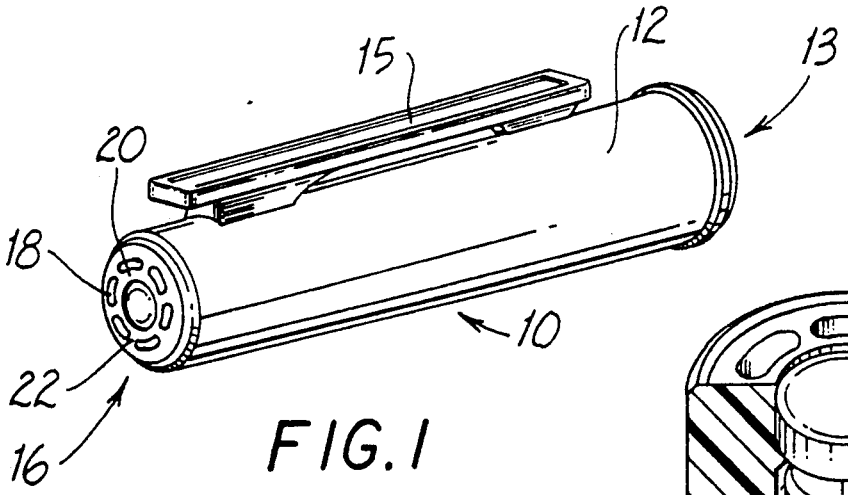
FIG. 1 is a perspective view of the removable cap of the present invention.

Referring now in specific detail to the drawings, in which like reference numerals identify similar or identical elements throughout the several views, FIGS. 1–4 illustrate a removable cap 10 in accordance with the present invention. Removable cap 10 is configured to detachably receive and enclose the writing or nib portion of a writing implement as shown in phantom in FIG. 2.

Removable cap 10 includes main cap member 12 and inner cap member 14 which is suspendedly mounted to the main cap member. Main cap member 12 is preferably cylindrically shaped having an opening at a first end and a partial enclosure wall 16 integrally formed with member 12 at a second end. Inner cap member 14 is preferably generally cylindrically shaped, but may taper towards its closed end to receive and seal the writing portion of an implement in a generally frustoconical shape.

Partial enclosure wall 16 includes a circumferential hub 20 concentric with an outer wall of main cap 12 having a central opening 21, with six radially extending ribs 22 projecting from the hub. As shown in FIG. 4, ribs 22 also provide support and stability to hub 20 so that the hub can receive and secure inner cap 14 during assembly. Ribs 22 are shaped so as to define six arcuately shaped apertures or voids 18 surrounding hub 20, apertures 18 providing a passageway through which the interior of removable cap 10 communicates with external air when cap 10 is removed from the implement. It is to be appreciated that the number of ribs 22 and apertures 18 is not limited to six.

Referring now to FIGS. 4 and 5, the mounting means for securing the inner cap member 14 to main cap member 12 is illustrated. Circumferential hub 20 is configured to receive and mount inner cap member 14 and includes a circumferential ledge member 24 projecting from the inner peripheral surface of the hub and disposed on the hub at a position intermediate the lower and upper edges of the hub. Ledge member 24 may also be positioned adjacent a lower edge of the hub. A beveled surface 26 extends from the ledge member 24 to a generally vertical surface 28 of hub 20. FIG. 5 illustrates an enlarged view of this surface in detail. As shown, vertical surface 28 extends to lower edge 30 of the hub.

Inner cap member 14 includes a circumferential groove 32 disposed adjacent the closed end of the inner cap, groove 32 defining a head portion 34 on a first side of the groove and a stepped raised edge 36 on the second side, which extends from groove 32 to the remaining body portion of the inner cap. The diameter of head portion 34 is slightly less than the diameter of the inner peripheral surface of hub 20, but is larger than the inner diameter of circumferential ledge member 24. It is also preferable for the diameter of raised edge 36 to be larger than the diameter of circumferential hub 20 for reasons described below.

In assembly, inner cap 14 is inserted within main cap member 12, and is then advanced towards partial enclosure wall 16 (as shown in FIG. 4) with head portion 34 engaging beveled surface 26 of hub 20. The tapering feature of bevel surface guides head portion 34 through circumferential hub 20, wherein head portion 34 is forcibly inserted through the circumferential hub 20 until the lower edge of head portion 34 clears beveled surface 26 and rests on circumferential ledge 24. Once inserted, inner cap 14 is suspendedly mounted to partial enclosure wall 16 by the engagement of the lower edge of head portion 34 with circumferential ledge member 24. Head portion 34 is also maintained within hub 20 by the engagement of stepped raised edge 36 of inner cap 14 with the lower edge 30 of the circumferential hub. Thus, inner cap 14 is suspendedly mounted to main cap member 12 by the engagement of circumferential hub 20 with head portion 34 of the inner cap 14.

The mounting means of the present invention mounts inner cap 14 in general axial alignment with main cap member 12. However, it is to be appreciated that the mounting means of the present invention allows for slight pivotal movement of inner cap 14 relative to the main cap body. This is made possible since the inner cap is mounted in suspension at its closed end to the main cap member, while there is no other contact between the remaining portion of the inner cap member 14 with the main cap member 12. This is a feature of the present invention and finds application when component dimensions are not met with precision during manufacture and the inner cap in its assembled position is not aligned with the central axis of the main cap member. In such situations, as the writing portion of the implement enters the inner cap, the inner cap pivots around its mounted head portion 34 to receive the writing point of the implement and realign its position relative to the main cap member.

Figure 2:
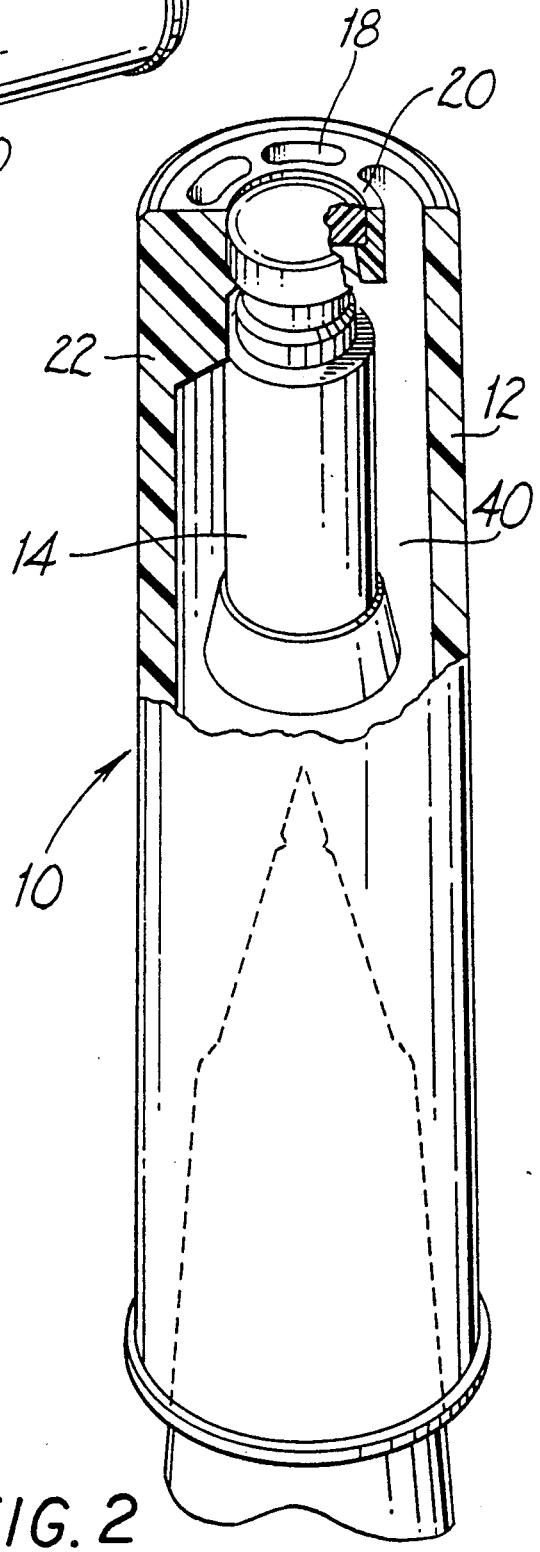
FIG. 2 is a perspective view in partial cross-section of a longitudinal section of the removable cap of FIG. 1.
Figure 3:
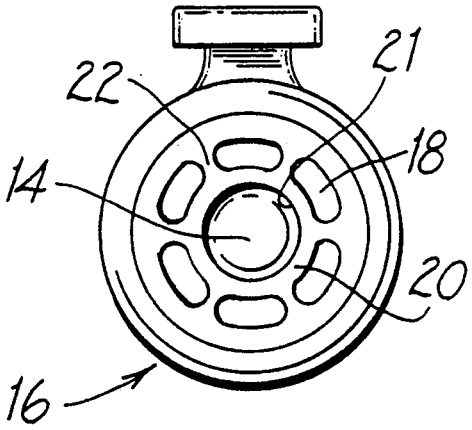
FIG. 3 is an end view of the removable cap of FIG. 1.

As shown in FIG. 2, removable cap 10 in its assembled condition provides a passageway for air to flow through the cap when the cap is detached from the implement. Arcuately shaped apertures 18 of partial enclosure wall 16 are in communication with a channel 40 defined between the outer peripheral surface of inner cap member 14 and the inner peripheral surface of the main cap member 12. Channel 40 is in direct communication with the open end of main cap member 12.

When the removable cap 10 of the present invention is mounted on the writing implement, inner cap member 14 encloses and seals the writing portion of the implement, thereby preventing evaporation of ink and protecting the functional components of the implement from damage. Removable cap 10 may be detachably mounted to the implement by conventional methods.

Figure 6:
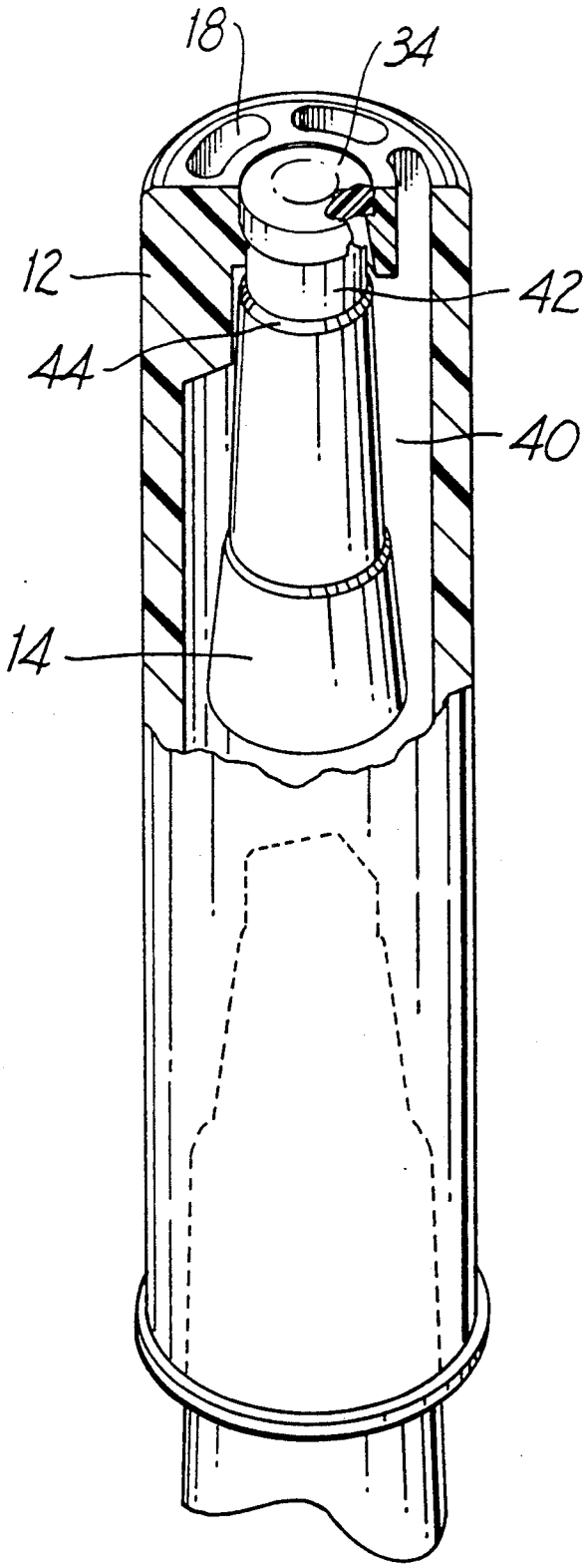
FIG. 6 is a perspective view in partial cross-section of a longitudinal section of an alternative embodiment of the present invention.

FIGS. 6–8 illustrate an alternate embodiment of the removable cap of the present invention. In accordance with this embodiment, ribs 22 are longer in length than the ribs of the embodiment of FIG. 2 and, as such, extend further axially along main cap member 12. This feature provides additional support and stability to circumferential hub 20. Inner cap 14 tapers to form a frusto-conical shape, to correspond with the tapering of the writing portion to be received. Inner cap 14 includes circumferential groove 42 forming raised edge 44 on the body portion side of the groove. When head portion 34 of inner cap 14 is mounted onto ledge member 24 of circumferential hub 20, raised edge 44 abuts the lower edge 30 of hub 20 to retain the inner cap within the circumferential hub. The embodiment of FIGS. 6–8 is similar in all other respects to the embodiment of FIGS. 1–5.

Figure 9:
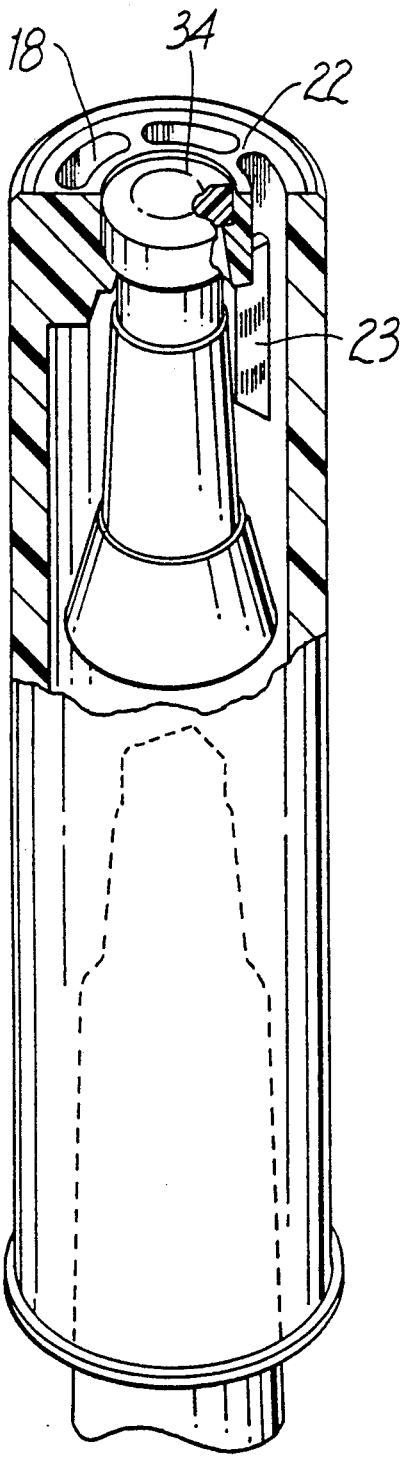
FIG. 9 is a perspective view in partial cross-section of a longitudinal section of another embodiment of the present invention.
Figure 10:
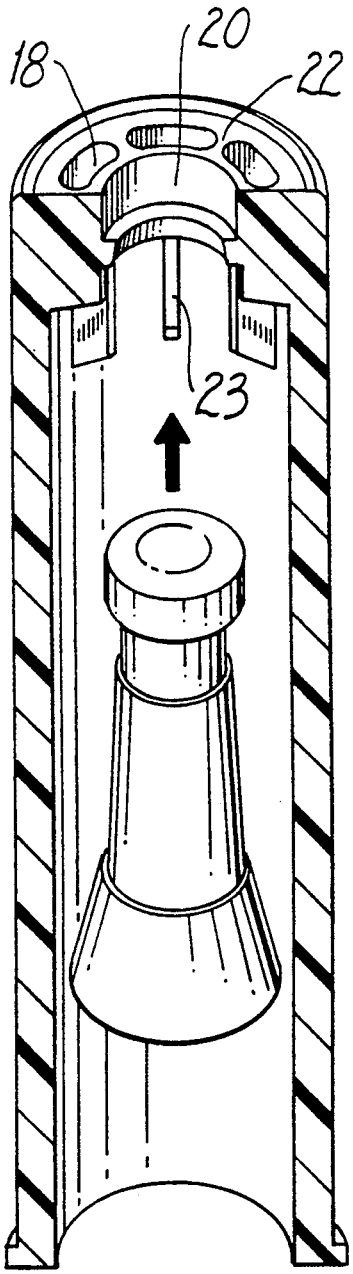
FIG. 10 is a perspective cross-sectional view of the longitudinal section of the embodiment of FIG. 9 prior to assembly.
Figure 11:
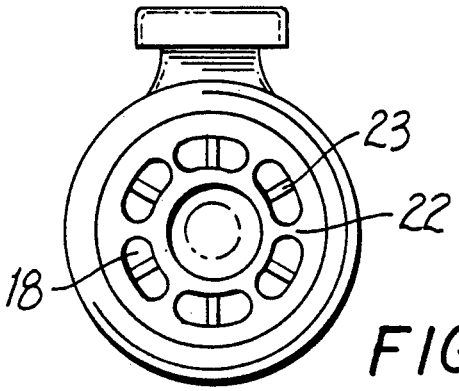
FIG. 11 is an end view of the embodiment of FIG. 9.

FIGS. 9–11 illustrate another embodiment of the removable cap 10 of FIG. 1, in which a supplemental rib 23 is provided between each rib 22. Supplemental ribs 23 provide even further support to circumferential hub 20 and are integrally formed with the inner peripheral surface of main cap member 12 and the interior or lower portion of hub 20.

Figure 12:
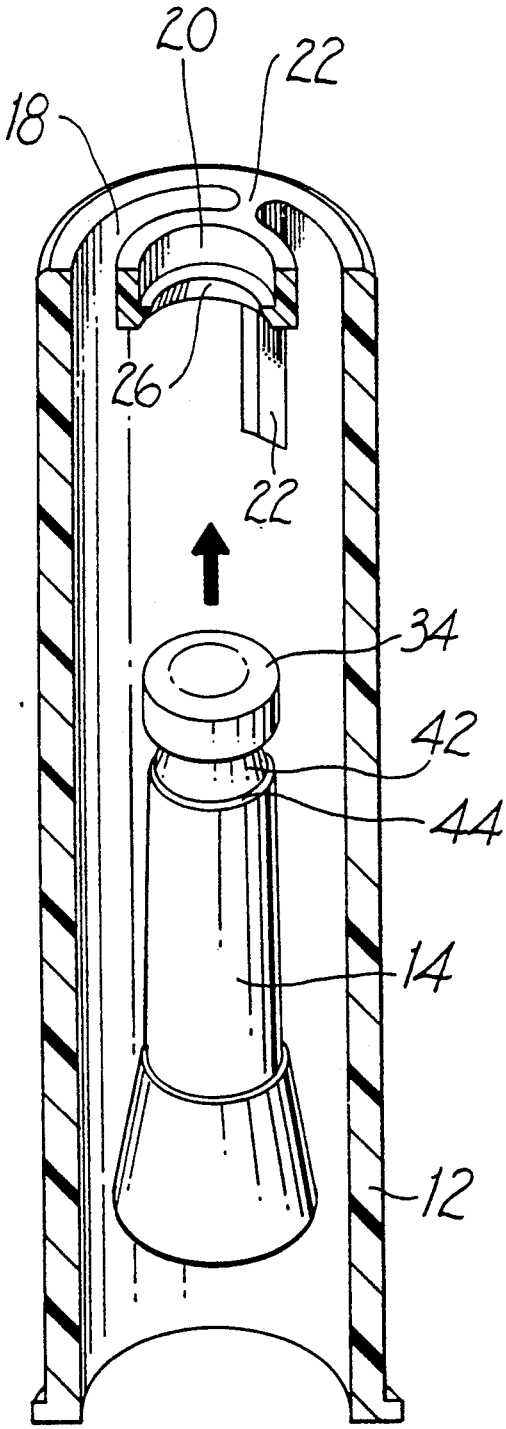
FIG. 12 is a perspective cross-sectional view of a longitudinal section of another embodiment of the present invention prior to assembly.
Figure 13:
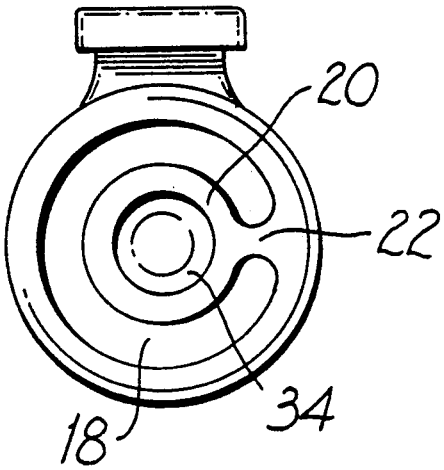
FIG. 13 is an end view of the embodiment of FIG. 12.

FIGS. 12 and 13 illustrate a further embodiment of the present invention. In accordance with this embodiment, circumferential hub 20 possesses only one radial rib 22, which defines one arcuately shaped aperture 18. Radial rib 22 is dimensioned and configured to support circumferential hub 20 and inner cap 14 after assembly as best seen in FIG. 13.

Figure 14:
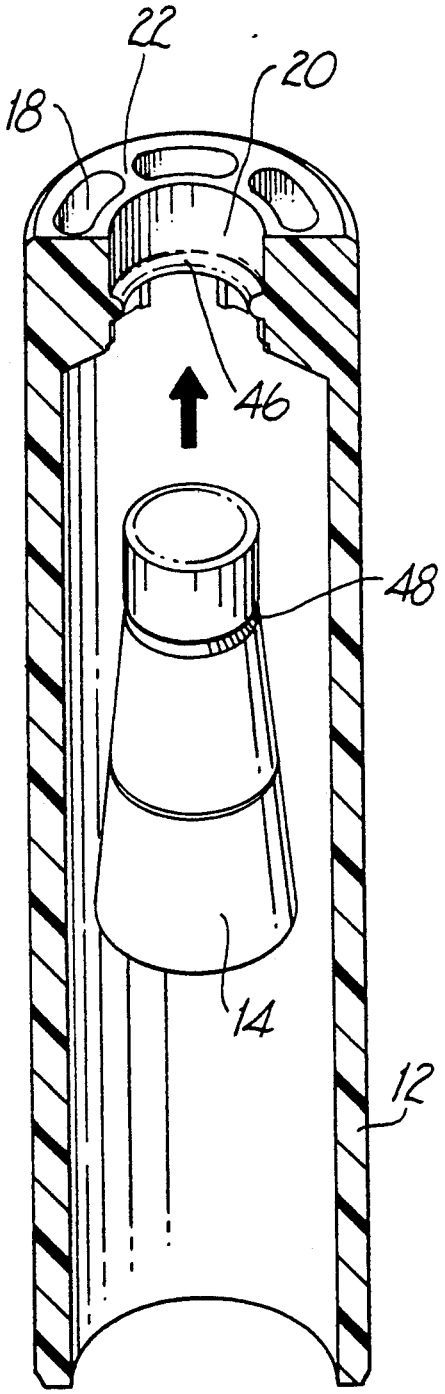
FIG. 14 is a perspective cross-sectional view of a longitudinal section of still another embodiment of the present invention prior to assembly.
Figure 15:
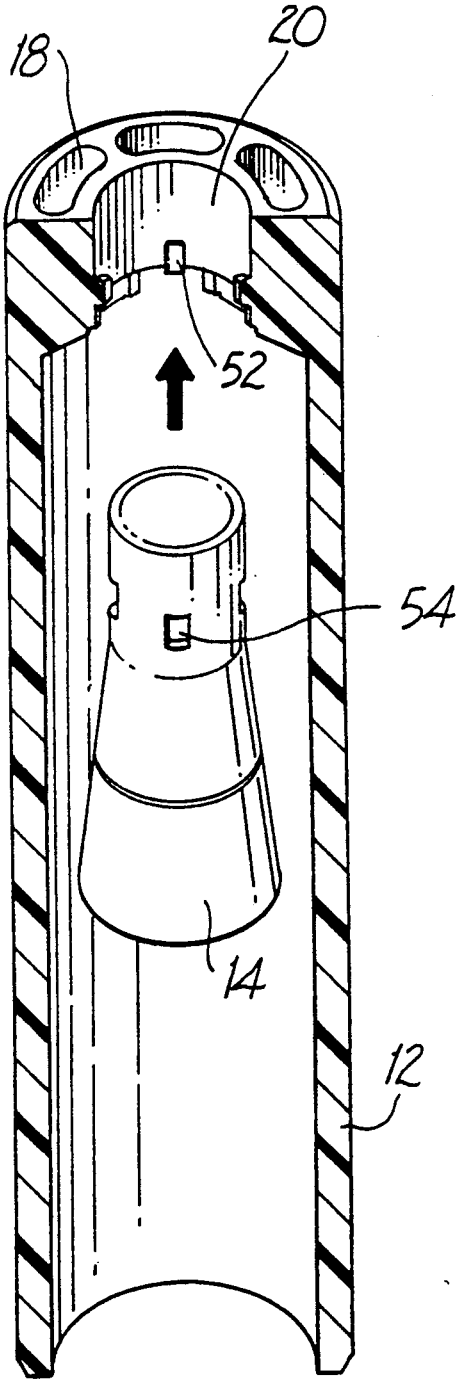
FIG. 15 is a perspective cross-sectional view of a longitudinal section of a further embodiment of the present invention prior to assembly.
Figure 16:
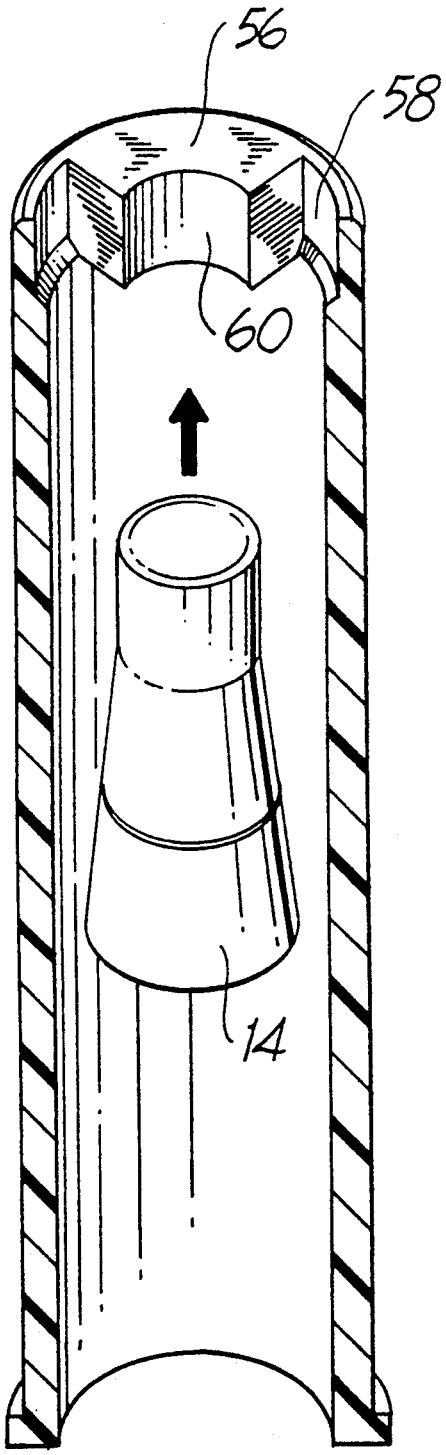
FIG. 16 is a perspective cross-sectional view of a longitudinal section of another embodiment of the present invention prior to assembly.

It is also within the scope of the present invention to suspendedly mount inner cap 14 to main cap member 12 by alternate methods. Referring to FIG. 14, circumferential hub 20 may be provided with a hemispherically shaped circumferential rib 46 and the inner cap 14 may possess a circumferential groove 48 adjacent its closed end which interlocks with rib 46 to mount the inner cap member to the hub. In the alternative, circumferential hub 20 may be provided with a plurality of tabs 52 which interlock with corresponding slots or recesses 54 provided in the inner cap to mount the inner cap member as shown in FIG. 15. Slots 54 do not penetrate through cap 14, in order to maintain the air-tightness within cap 14 when a writing implement is positioned therein. It is also possible to mount inner cap member 14 to circumferential hub 20 by adhesive means.

Figure 17:
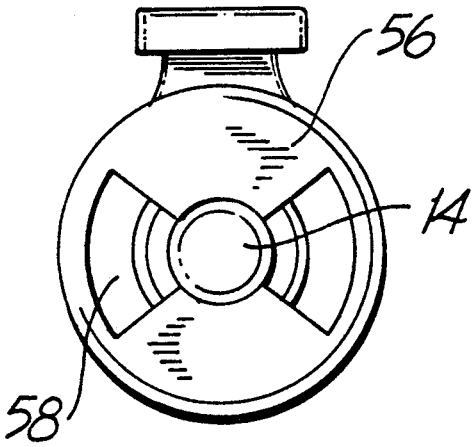
FIG. 17 is an end view of the embodiment of FIG. 16.
Figure 18:
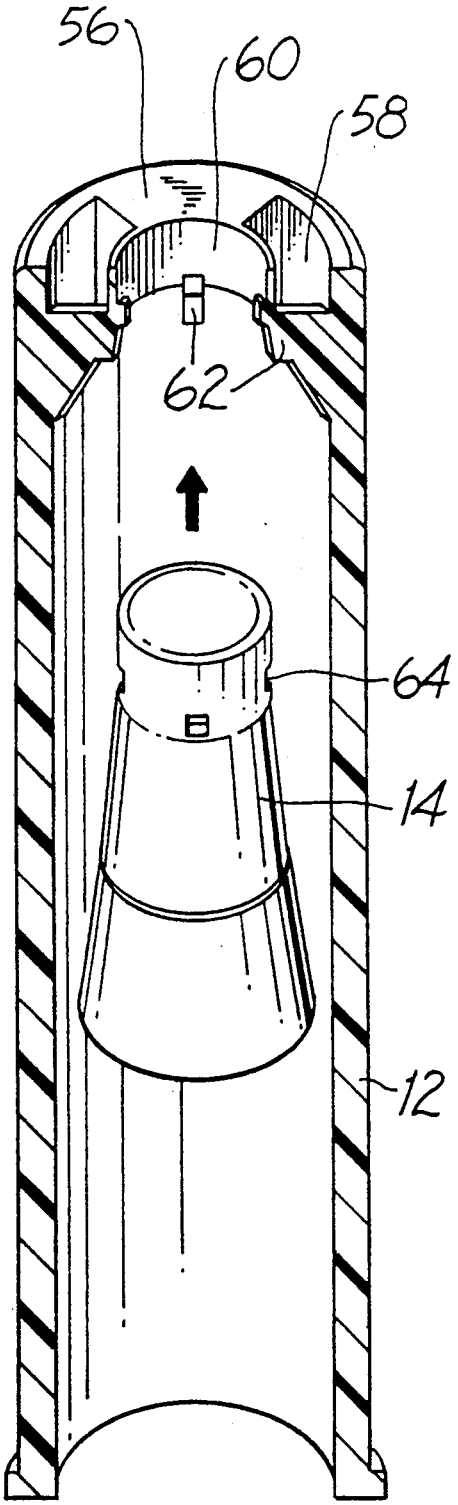
FIG. 18 is a perspective cross-sectional view of a longitudinal section of yet another embodiment of the present invention prior to assembly.
Figure 19:
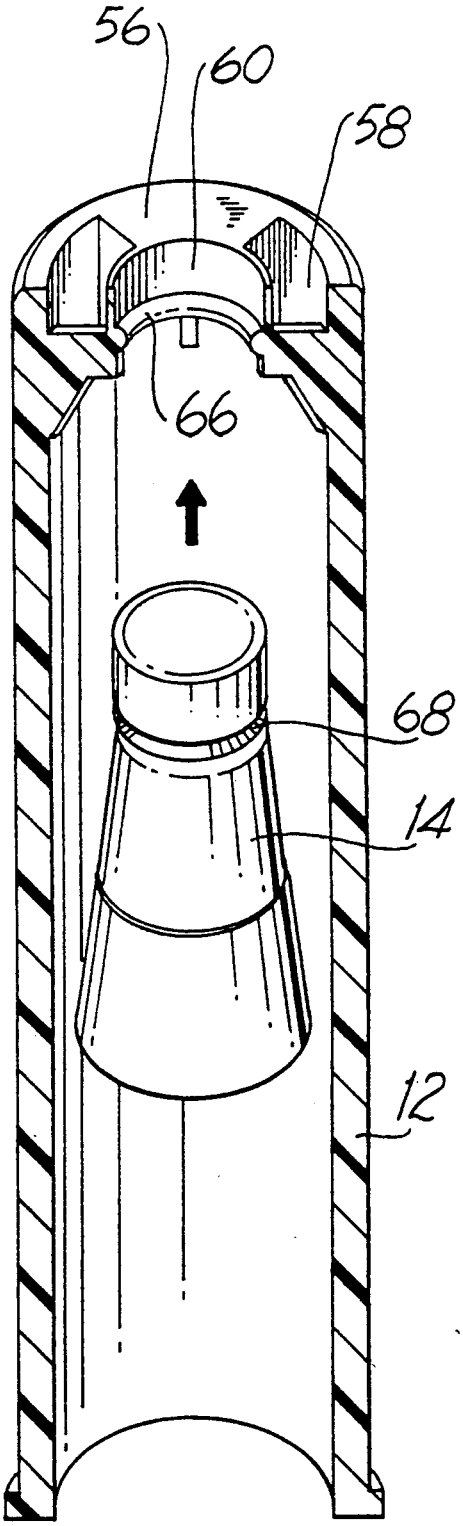
FIG. 19 is a perspective cross-sectional view of a longitudinal section of a further embodiment of the present invention prior to assembly.
Figure 20:
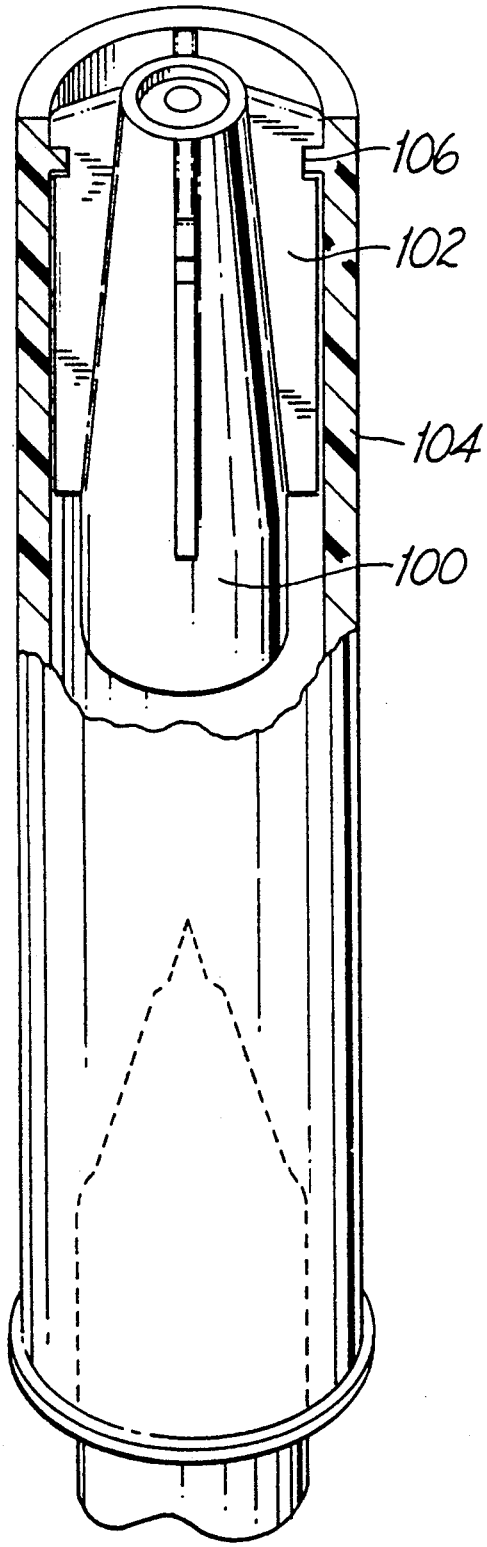
FIG. 20 PRIOR ART
FIG. 20 is a perspective view in partial cross-section of a longitudinal section of a conventional removable cap.
Figure 21:
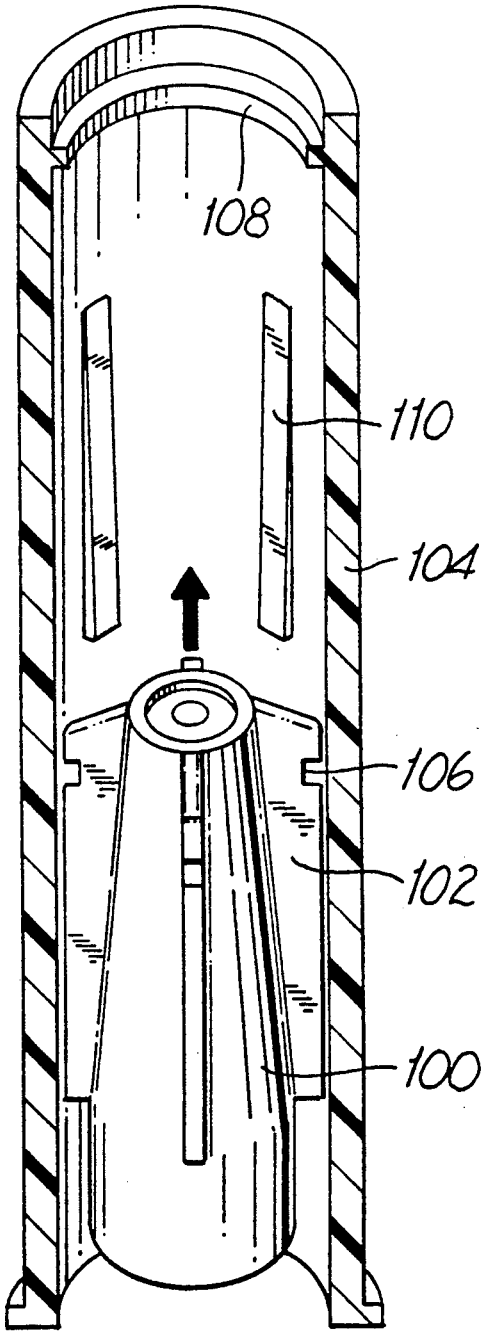
FIG. 21 PRIOR ART
FIG. 21 is a perspective cross-sectional view of a longitudinal section of the convention removable cap of FIG. 20 prior to assembly.

Referring now to FIGS. 16–19, another embodiment of the removable cap of the present invention is illustrated. In accordance with this embodiment, circumferential hub 20 is replaced by two land portions 56, land portions 56 having engaging surfaces 60. Land portions 56 define two apertures 58 in the enclosing wall as best seen in FIG. 17. Inner cap 14 may be mounted in suspension to land portions 56 by any of the aforementioned methods. For example, referring to FIG. 18, engaging surfaces 60 of land portions 56 may include tabs 62 which interlock with slots 64 provided in inner cap 14 to mount the inner cap in suspension to main cap member 12. In the alternative, land portions 56 may include an arcuate hemispherically shaped rib 66 which interlocks with an arcuate groove 68 in the inner cap to effect the mounting as shown in FIG. 19. In addition, inner cap 14 may be mounted by adhesive means, as in FIG. 16.

It will be understood that various modifications may be made to the embodiments of the present invention herein disclosed without departing from the spirit thereof. The above description should not be construed as limiting the invention but merely as exemplifications of preferred embodiments thereof. Those skilled in the art will envision other modifications within the scope and spirit of the present invention as defined by the claims appended hereto.

What is claimed is:

1. A removable cap for receiving a writing implement comprising:

a generally cylindrical member having an opening at a first end for receiving the implement and a partial enclosure wall integrally formed with said cylindrical member at a second end, said partial enclosure wall comprising a circumferential hub having a central opening, said hub being concentric with said cylindrical member and having at least one radially extending rib projecting between said hub and said cylindrical member, said rib defining at least one generally arcuately shaped opening between said hub and said cylindrical member through which the interior of said cylindrical member communicates with air external to said cylindrical member;

an inner cap member disposed within said cylindrical member and in general axial alignment therewith, said inner cap member being opened at a first end and closed at a second end for receiving and sealing a writing point of the implement; and mounting means for suspendedly mounting said inner cap member at said second end thereof to said circumferential hub.

2. The removable cap of claim 1, wherein said mounting means comprises a circumferential groove disposed adjacent said second end of said inner cap which engages an annular rib disposed on an inner peripheral surface of said circumferential hub.

3. The removable cap of claim 1, wherein said inner cap member further comprises a circumferential groove disposed adjacent said second end of said inner cap member, said circumferential groove defining a head portion at said second end of said inner cap member and a raised edge at a position intermediate said first end of said inner cap member and said circumferential groove.

4. The removable cap of claim 3, wherein said circumferential hub further comprises a circumferential ledge member disposed on an inner surface of said circumferential hub, said circumferential ledge member having an inner diameter that is less than the diameter of said head portion of said inner cap member.

5. The removable cap of claim 4, wherein said head portion is received within said circumferential hub and said groove engages with said circumferential ledge member of said circumferential hub to suspendedly mount said inner cap member to said circumferential hub.

6. The removable cap of claim 5, wherein the inner diameter of said circumferential hub is less than the diameter of said raised edge of said inner cap member; and wherein said raised edge engages an interior end surface of said circumferential hub to retain said head portion of said inner cap member within said circumferential hub.

7. The removable cap of claim 4, wherein said circumferential ledge member is disposed adjacent an interior end surface of said circumferential hub.

8. The removable cap of claim 4, wherein said circumferential hub further comprises a beveled surface extending from an interior end surface of said circumferential hub to said circumferential ledge member, said beveled surface facilitating the insertion of said inner cap member within said circumferential hub during assembly.

9. The removable cap of claim 1, wherein said mounting means comprises at least one radially projecting tab disposed on said circumferential hub and at least one corresponding recess disposed adjacent said second end of said inner cap member, said tab and said recess interlocking to mount said inner cap member to said partial enclosure wall.

10. The removable cap of claim 1, wherein said mounting means comprises adhesive means securing said second end of said inner cap member to said circumferential hub.

11. The removable cap of claim 1, wherein said inner cap member is generally frusto-conically shaped.

12. The removable cap of claim 1, wherein said partial enclosure wall comprises six radially extending ribs defining six generally arcuately shaped openings.

13. The removable cap of claim 1, wherein said partial enclosure wall further comprises a supplemental radially extending rib positioned between each of said radially extending ribs, said supplemental rib providing additional support to said circumferential hub.

14. The removable cap of claim 2, wherein said groove has a cross-sectional length greater than a cross-sectional length of said rib, such that said inner cap member is pivotably movable within said cylindrical member.

15. A removable cap for receiving a writing implement comprising:

a generally cylindrical member having an opening at a first end for receiving the implement and a partial enclosure wall integrally formed with said cylindrical member at a second end of said cylindrical member, said partial enclosure wall comprising a closed circumferential hub having a central opening, said hub being concentric with said cylindrical member, and a plurality of radially extending ribs projecting between said hub and said cylindrical member, said ribs defining a plurality of generally arcuately shaped openings surrounding said circumferential hub through which the interior of said cylindrical member communicates with air external to said cylindrical member, said circumferential hub including a circumferential ledge disposed on an inner surface of said hub; and an inner cap member disposed within said cylindrical member and in general axial alignment therewith, said inner cap member being open at a first end and closed at a second end for receiving and sealing a writing point of the implement, said inner cap member having a circumferential groove disposed adjacent said second end of said inner cap member, said circumferential groove defining a head portion at said second end of said inner cap member and a raised edge at a position intermediate said groove and said first end of said inner cap member;

wherein said head portion of said inner cap is received within said circumferential hub, said groove engaging said circumferential ledge of said circumferential hub to suspendedly mount said inner cap to said circumferential hub.

16. The removable cap of claim 15, wherein said raised edge engages a first end of said circumferential hub to retain said head portion of said inner cap member within said circumferential hub.

17. A removable cap for receiving a writing implement comprising:

a generally cylindrical member having an opening at a first end for receiving the implement and a partial enclosure wall integrally formed with said cylindrical member at a second end of said cylindrical member, said partial enclosure wall comprising a closed circumferential hub concentric with said cylindrical member and six radially extending ribs projecting therefrom, said ribs defining six generally arcuately shaped openings surrounding said circumferential hub through which the interior of said cylindrical member communicates with air external to said cylindrical member, said circumferential hub comprising a circumferential ledge disposed on an inner surface of said circumferential hub; and an inner cap member disposed within said cylindrical member and in general axial alignment therewith, said inner cap member being opened at a first end and closed at a second end for receiving and sealing a writing point of the implement, said inner cap member comprising a circumferential groove disposed adjacent said second end of said inner cap member, said circumferential groove defining a head portion at said second end of said inner cap member and including a stepped raised edge between said head portion and a body portion of said inner cap member, said head portion having a diameter greater than the diameter of said circumferential ledge of said circumferential hub, and said raised edge having a diameter greater than the inner diameter of said circumferential hub;

wherein said head portion is received within said circumferential hub and engages with said circumferential ledge of said circumferential hub to suspendedly mount said inner cap to said circumferential hub, and wherein said stepped raised edge engages an interior end surface of said circumferential hub to retain said head portion of said inner cap member within said circumferential hub.

18. A removable cap for receiving a writing implement, comprising:

a generally cylindrical member having an opening at a first end for receiving the implement and a partial enclosing wall at a second end, said partial enclosing wall integrally formed with said cylindrical member and including at least one radially projecting land portion defining at least one aperture through which the interior of said cylindrical member communicates with air external to said cylindrical member; and an inner cap member disposed within said cylindrical member and in general axial alignment therewith, said inner cap member being opened at a first end and closed at a second end for receiving and sealing a writing point of the writing implement; and mounting means for suspendedly mounting said inner cap member at a second end thereof to said partial enclosing wall.

19. The removable cap of claim 18, wherein said mounting means comprises at least one radially projecting tab extending from said land portion which engages at least one corresponding recess in said second end of said inner cap member, such that said tab and said recess interlock to suspendedly mount said inner cap member to said partial enclosure wall.

20. The removable cap of claim 18, wherein said mounting means comprises an arcuate rib disposed on said land portion which engages an arcuate groove in said second end of said inner cap member, such that said groove and said rib interlock to suspendedly mount said inner cap member to said partial enclosure wall.

21. The removable cap of claim 18, wherein said mounting means comprises adhesive means for mounting said second end of said inner cap member to said partial enclosure wall.

22. The removable cap of claim 18, wherein said partial enclosure wall comprises two radially projecting land portions defining two apertures through which the interior of said cylindrical member communicates with air external to said cylindrical member.

23. The removable cap of claim 1, wherein said mounting means permits pivotal movement of said inner cap member about its second end.

24. The removable cap of claim 15, wherein said inner cap member is pivotally movable about its second end.

25. The removable cap of claim 17, wherein said inner cap member is pivotally movable about its second end.

26. The removable cap of claim 18, wherein said mounting means permits pivotal movement of said inner cap member about its second end.

27. A removable cap for receiving a writing implement comprising:

a generally cylindrical member having an opening at a first end for receiving the implement and a partial enclosure wall integrally formed with said cylindrical member at a second end, said partial enclosure wall comprising a circumferential hub having a central opening, said hub being concentric with said cylindrical member and having at least one radially extending rib projecting between said hub and said cylindrical member, said rib defining at least one generally arcuately shaped opening between said hub and said cylindrical member to permit unrestricted air flow through said partial enclosure wall;

an inner cap member disposed within said cylindrical member and in general axial alignment therewith, said inner cap member being opened at a first end and closed at a second end for receiving and sealing a writing point of the implement; and mounting means for suspendedly and pivotally mounting said inner cap member at said second end thereof to said circumferential hub.

* * * * *